US005292205A

United States Patent [19]

Burke et al.

[11] Patent Number: 5,292,205

[45] Date of Patent: * Mar. 8, 1994

[54] BACKUP PROTECTION FOR SEALED STRUCTURAL EXPANSION JOINTS

[75] Inventors: Bertram V. Burke, N. Plainfield, N.J.; David Hall, Gansevoort; Jay Burdett, Saratoga Springs, both of N.Y.

[73] Assignee: Infrastructure Protection Systems, Inc., Florham Park, N.J.

[ * ] Notice: The portion of the term of this patent subsequent to Aug. 25, 2009 has been disclaimed.

[21] Appl. No.: 834,060

[22] Filed: Feb. 11, 1992

Related U.S. Application Data

[63] Continuation-in-part of Ser. No. 653,254, Feb. 11, 1991, Pat. No. 5,141,358.

[51] Int. Cl.[5] ..... E01C 11/02

[52] U.S. Cl. ..... 404/49; 404/68

[58] Field of Search ..... 404/47, 48, 49, 68, 404/87, 54

[56] References Cited

U.S. PATENT DOCUMENTS

| | | | |
|---|---|---|---|
| 580,701 | 4/1897 | McMenamin | 404/54 |
| 4,699,540 | 10/1987 | Gibbon et al. | 404/49 |
| 4,804,292 | 2/1989 | DeLuca | 404/69 |

FOREIGN PATENT DOCUMENTS

| | | | |
|---|---|---|---|
| 1175745 | 12/1969 | United Kingdom | 404/48 |

*Primary Examiner*—William P. Neuder

[57] ABSTRACT

A retrofit for diverting water leaking into an elevated expansion joint is formed by lowering an applicator that carries an adhesively treated water run-off arrangement into the joint and pressing the arrangement against inside walls of the joint with an expanding bladder under fluid pressure. When the adhesive cures, reducing the pressure collapses the bladder and allows withdrawal of the applicator.

18 Claims, 7 Drawing Sheets

BACKUP PROTECTION FOR SEALED STRUCTURAL EXPANSION JOINTS

RELATED APPLICATIONS

This is a continuation-in-part of our pending application Ser. No. 653,254, filed Feb. 11, 1991 now U.S. Pat. No. 5,141,358. The subject matter of that application is incorporated into this application as if recited herein.

BACKGROUND OF THE INVENTION

This invention relates to backup protection for sealed structural expansion joints, and particularly to retrofitted backup protection of structural members against water seeping around seals at expansion joints of elevated structures such as bridges or decks.

Elevated roadways with steel or concrete-steel superstructures generally sit on concrete piers with steel bearings. Such roadways expand and contract continuously with hourly changes in temperature, as well as seasonal temperature variations. They also move in response to other forces. Expansion joints, forming gaps between sections of roadway that rest on the pier caps, accommodate this movement, growth, and shrinkage. The expansion joints usually extend transversely across tho road, but may also follow longitudinally along the roadway. To prevent run-off water from damaging the supporting piers and caps, the expansion joints include elastically compressible seals secured in the gaps between the roadway sections. These seals shunt most of the water and other liquid materials that accumulate on a roadway away from gaps. The seals themselves resiliently reshape to fill the gaps between the roadway sections.

However, the seals are not perfect. Some of the water, caused by rain and snow and accompanying oils and other materials from leaking automobiles, pass by the seals and ultimately damage the structural piers and bearings supporting the roadway. Because the damage is so slow, it may not be recognized before the conditions become unsafe.

U.S. Pat. No. 4,804,292 illustrates a run-off arrangement for deflecting and collecting water seepage from the seals and diverting it to the sides of the roadway beyond the underlying piers and bearings. However, it is necessary to incorporate the run-off system into the bridge structure during initial construction, or to make it part of a dramatic rehabilitation project.

Accordingly, existing roadways cannot benefit from such a run-off system without reconstruction.

OBJECTS AND SUMMARY OF THE INVENTION

An object of the invention is to overcome these difficulties.

According to a feature of the invention, these objects are obtained, in whole or in part, by horizontally pressing adhesively backed run-off members against opposite faces at the gap of existing expansion joints either simultaneously or successively with a horizontal thrusting device that a suitable device lowers and retracts from the gap. Each member is a deflector although one of the members also coacts with the other deflector as a collector. The two deflectors overlap horizontally across the gap.

These and other features of the invention are pointed out in the claims. Other objects and advantages from the invention will becomes evident from the following detailed description when read in light of the accompanying drawings.

DETAILED DESCRIPTION OF PREFERRED EMBODIMENTS

Figure 1:
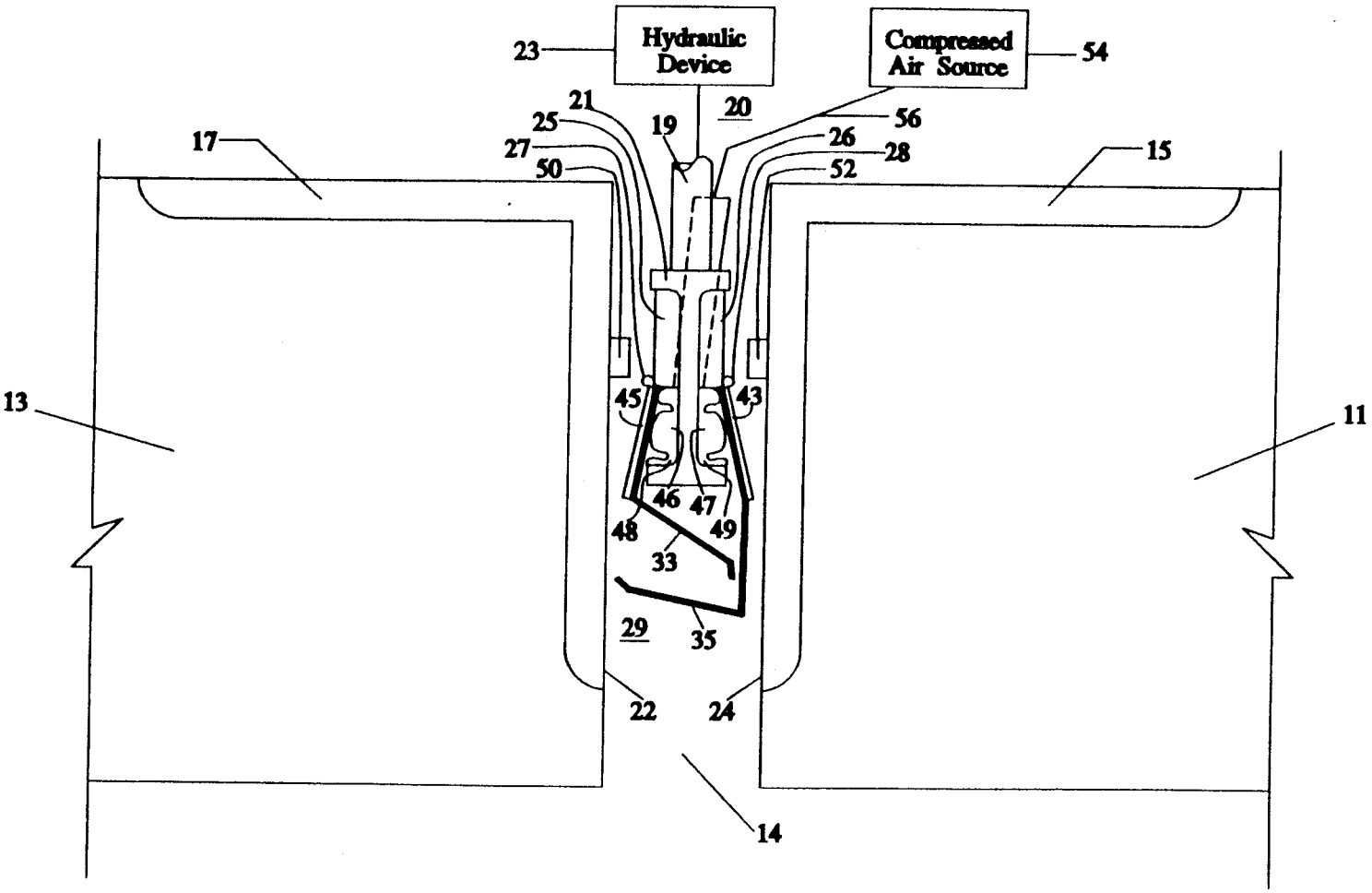
FIG. 1 shows a side cross sectional view of an apparatus in the process of applying a leak protection arrangement at the joint of two adjacent sections of roadway in accordance with an embodiment of the invention.

FIG. 1 is a cross sectional view of two adjacent concrete segments of roadway 11 and 13 at the location of an expansion joint 14. Protective armor sections 15 and 17 covering the edges of the roadway 11 and 13 prevent the underlying concrete from weathering along with the joint 14. A duct applicator generally designated 20 is placed within the joint 14. Prior to entry of the applicator 20, a cleaning apparatus (not shown) prepares the joint 14. The cleaning apparatus first cleans the roadway abutment joint 14 of any solid debris that had become stuck in the joint. Then the cleaning machine operates a rotating head that descends into the abutment joint and moves back and forth across the length of the joint 14. The rotating head of the cleaning machine removes any dirt, oil, paint or the like from the side surfaces 22 and 24 of the roadway edge armor sections 15 and 17 to expose the bare metal. This readies surfaces 22 and 24 of the edge armor sections 15 and 17 for the application of a joint.

The applicator 20 enters the abutment joint 14 between roadway segments 11 and 13. On the applicator 20 a movable shaft 19 controls a working head 21. The shaft 19 responds to a hydraulic servo, or other hydraulic device (schematical shown) 23 that is capable of dropping and lifting the working head 21 into various expansion joints.

The working head 21 of the applicator 20 descending into the abutment joint 14 includes two blocks 25 and 26 which removably hold two horizontally elongated magnetic, or spring, biasing clips 27 and 28. The latter bias a deflector plate 33 and a collector plate 35 of a run-off assembly 29 inwardly against the lower section of the head 21. The backs plates 33 and 35 bear respective resin reinforced fiber mat 43 and 45 saturated with an uncured water tight adhesive. Biasing clips 27 and 28 on the head 21 hold the deflector plate 33 and the collector plate 35 firmly against a lower section of the working head 21. Two elongated recesses 46 and 47 in the surface of the working head 21 hold respective inflatable bladders 48 and 49. The clips 27 and 28 urge the plates 33 and 35 against the bladders 48 and 49 to cause them to cover the bladders 48 and 49 and the recesses 46 and 47.

To Operate the applicator 20, the working head 21 receives a deflector plate 33 and a collector plate 35 in the biasing clips 27 and 28. The biasing clips 27 and 28 urge the plates 33 and 35 inwardly so they cover the aperture 46 and 47 and the uninflated bladders 48 and 49 within that apertures. The hydraulic device 23 now lowers the working head 21 into the joint 14 until the deflector plate 33 and the collector plate 35 are lower than two seal seats 50 and 52. The seal seats are part of the pre-existing joint to hold the joint seal.

Figure 2:
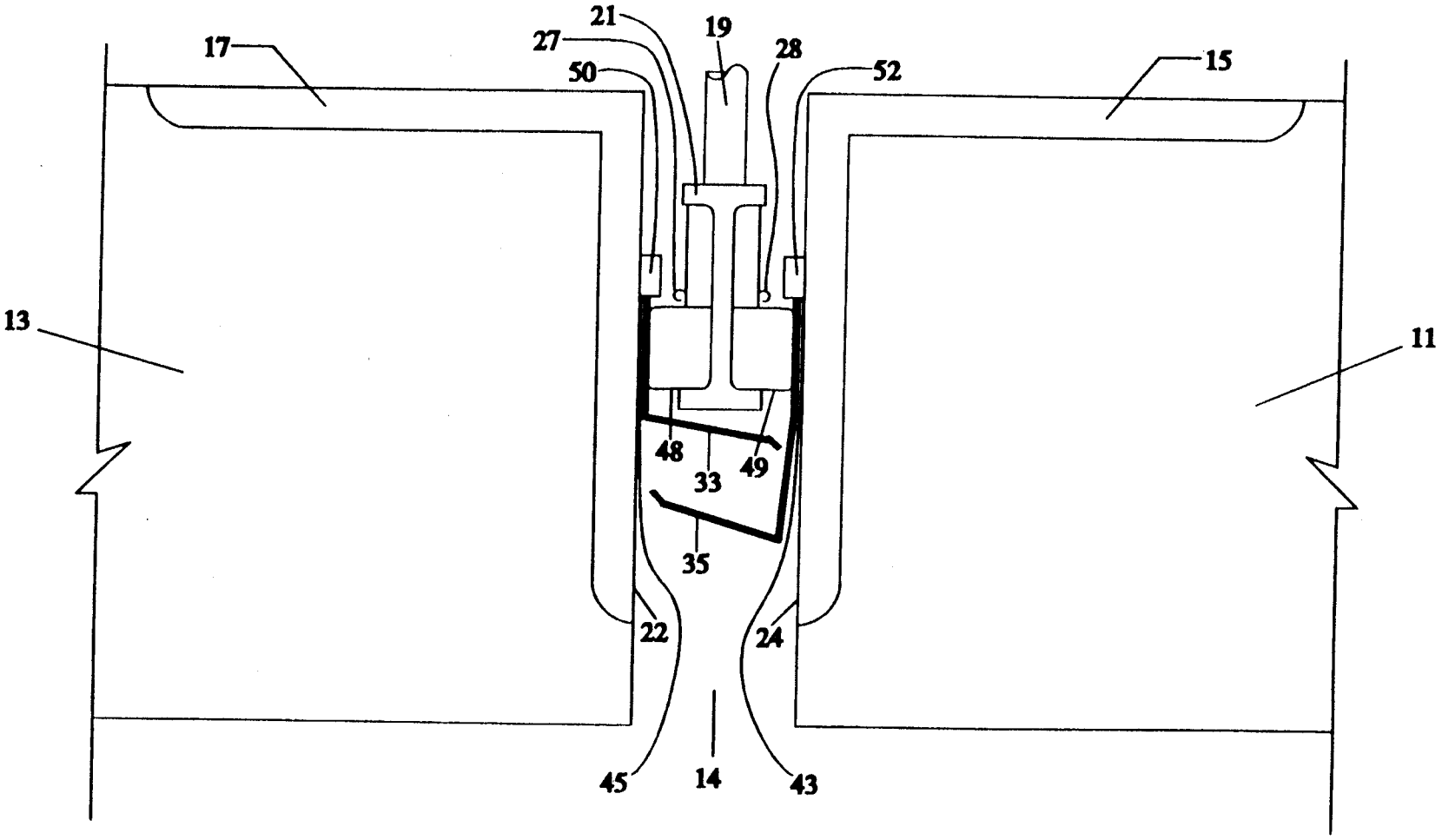
FIG. 2 shows the leak protective arrangement of FIG. 1 in place between adjacent segments of roadway.

A source 54 of compressed air now inflate bladders 48 and 49 through a suitable hose connection 56 so that the parts occupy the positions shown in FIG. 2. The inflation of the bladders 48 and 49 causes the bladders to expand beyond the recesses of the working head 21. The expanding bladders 48 and 49 press the deflector plate 33, and collector plate 35 outwardly from their positions on the working head 21. The expanding bladders 48 and 49 cause the deflector plate 33 and the collector plate 35, to separate from the bias clips 48 and 49 that held the plates 33 and 35 onto the working head 21. Once free of the spring bias clips 27 and 28 the deflector plate 33 and the collector plates 35 are forced outward by the expanding bladders 48 and 49. The outwardly moving deflector plate 33 and collector plate 35 contact the side surfaces 22 and 24 of edge armor or concrete face 15 and 17.

Once in contact, the expanded bladders 48, 49 hold the deflector plate 33 and the collector plate 35 firmly in place and press the resin reinforced fiber mats 43 and 45 behind the plates 33 and 35 against the side surfaces 21 and 24 of the edge armor faces 15 and 17. The adhesive coating the resin reinforced fiber mats 43 and 45 adheres to the side surfaces 22 and 24 of the edge armor 15 and 17. The compressed air fully inflates the bladders 29, 31 until the adhesive between the resin reinforced fiber mats 43 and 45 and the side surfaces 22 and 24 cures. Once cured, the bladders 48 and 49 are deflated to separate the contact between the head 20 and the deflector and collector plates 33 and 35. The detachment allows withdrawal of the head 20 from the joint 14. The applicator 20 is reloaded with a new length of deflector plate 33 and collector plate 35 and reinserted into a new area the joint 14 or another joint.

Figure 3:
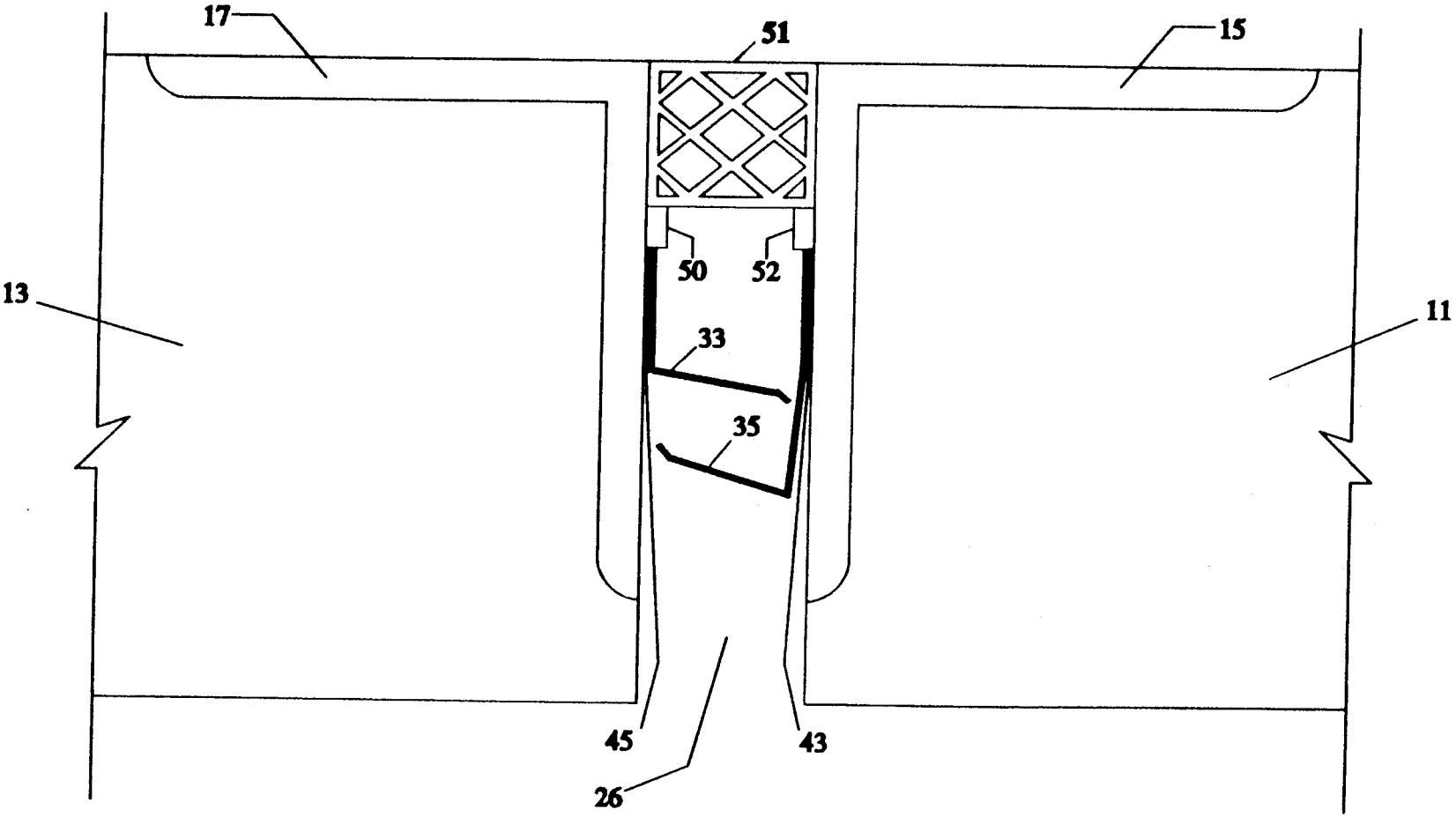
FIG. 3 shows a side cross-sectional view of a roadway abutment joint with the leak protective arrangement installed and the present invention removed.

FIG. 3 illustrates the deflector plate 33 and the collector plate 35 with the resin reinforced fiber mats 45 and 43 secured into place against the surfaces 22 and 24. The fiber mats 43 and 45 assure that the deflector plate 33 and the collector plate 35 adhere against the roadway edge armor. The body, thickness and compressibility of the fiber mats 45, 43 compensate for any surface irregularity that exists along the edge surfaces 22 and 24. The adhesive coating firmly secures the deflector plate 33 and the collector plate 35 below the seats 50 and 52 and 25 and after removal of the applicator 20, the abutment joint 14 receives a semiflexible compression seal 51 that prevents foreign material from falling into the joint 26.

The plates 33 and 35 follow the contour of the joint 14 across the roadway. They are thus pitched toward the sides of the roadway to form gutters that lead water to the edges of the roadway. The size of the applicator 20 varies for depending upon the dimensions of an joint 14 in a section of roadway. The size of the working head 21, inflatable bags 48 and 49 deflector plate 33, and collector plate 35 must fit to the space available within the abutment joint 14.

According to other embodiments of the invention, various shaped working heads make the present invention usable on odd shaped or odd angled abutment joints. The working head is in the form of I beam with insulating blocks.

According to still another embodiment, the applicator 20 holds and presses side guides 37 and 23 into place in the same manner that it installs the deflector plate 33 and the collector plate 35.

Figure 4:
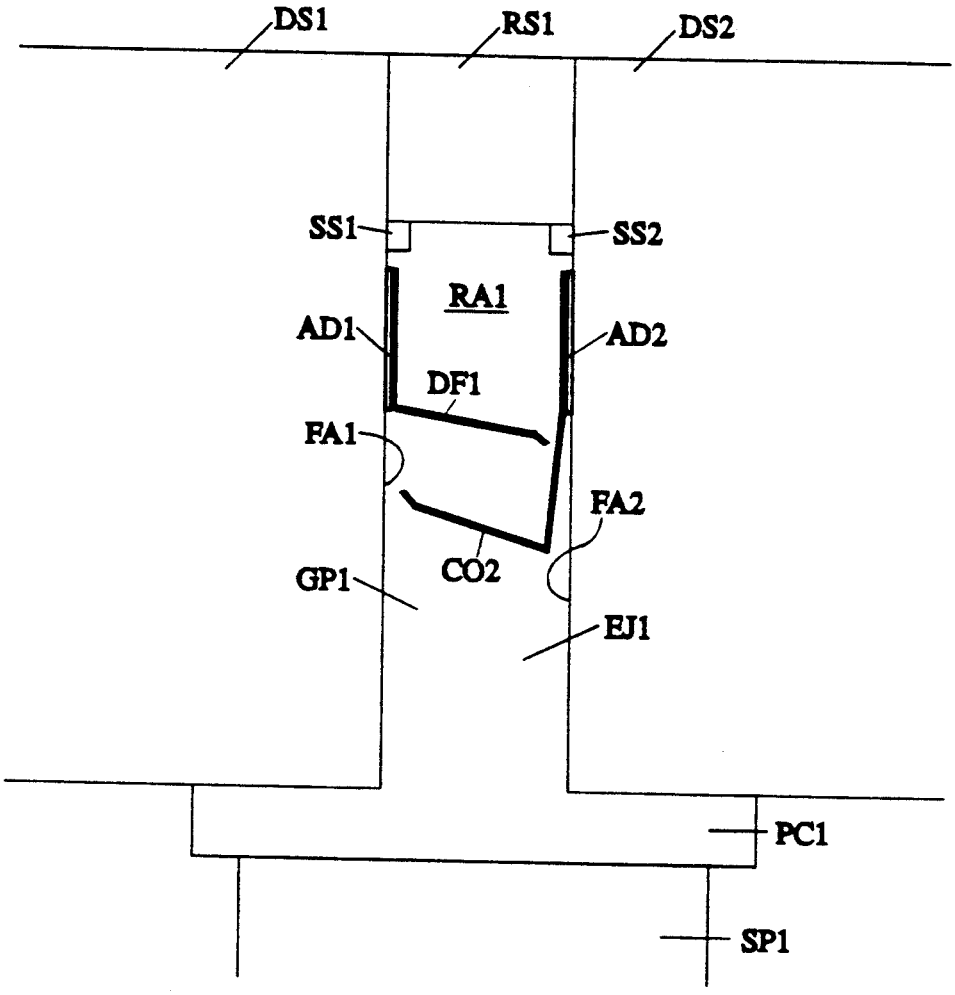
FIG. 4 is a cross sectional view of an expansion joint with a resilient seal and a run-off arrangement embodying features of the invention.

In FIG. 4, two roadway or deck sections, DS1 and DS2 sit on bearing BE over a pier cap PC1 atop a structural pier SP1 and form an expansion joint, EJ1 between them. A compressed resilient seal or strip seal RS1 seals the gap GP1 formed by the vertical faces FA1 and FA2 of the decks DS1 and DS2 at the expansion joint EJ1. The seal RS1 sits on two seal seats SS1 and SS2 secured to the faces FA1 and FA2. According to another embodiment, the faces FA1 and FA2 have metal protective armor such as shown in FIG. 1.

A liquid run-off arrangement RA1 includes a deflector DF1 secured against the face FA1 and a collector CO2 secured against the face FA2 by respective adhesive mounts AD1 and AD2. Each mount AD1 and AD2 takes the form of a resin impregnated reinforced fiber mat, a thick jelly, or any adhesive that fills the interstices between the deflector DF1 and the face FA1 on the one hand, and the interstices between the collector CO2 and the face FA2 on the other.

The deflector DF1 and collector CO2 are each in the form of a stainless steel, reinforced plastic coated carbon seal, or other non-corrosive sheet material bent as shown. The deflector DFI and the collector CO2 are, in fact, each deflectors. However, the collector CO2 serves both the function of a deflector and a collector.

In operation, the seal RS1 prevents most liquid, made up largely of water and small amounts of other roadway liquid, from passing into the gap GP1 of the joint EJ1. However, the deflector DF1 passes any of the liquid at the left side of the seal into the collector CO1. The collector CO1 mounted on the face FA2 receives the remaining liquid not deflected by the deflector DF1. The collector CO2 is tilted in the horizontal direction (into the page in FIG. 1) to pass the collected liquid beyond the structural pier SP1 and the pier cap PC1.

Figure 5:
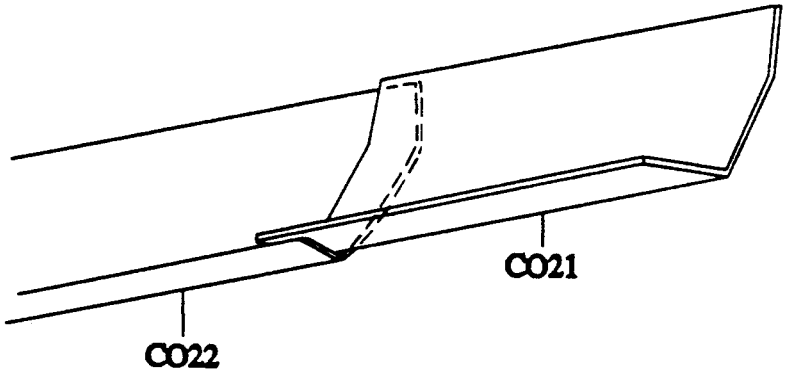
FIG. 5 is a perspective view showing several overlapping adjacent collectors.

The run-off arrangement CA1 may be composed of a single deflector DF1 and a single collector CO2 extending across an entire roadway or may constitute horizontally overlapping deflectors and collectors of which overlapping collectors CO2 are shown in FIG. 5. The collector CO2 are pitched downwardly toward the edges of the deck and identified as CO21 and CO22. To prevent leakage, extra thicknesses of adhesive AD2 are applied near the overlap portion of the section CO21.

Figure 6:
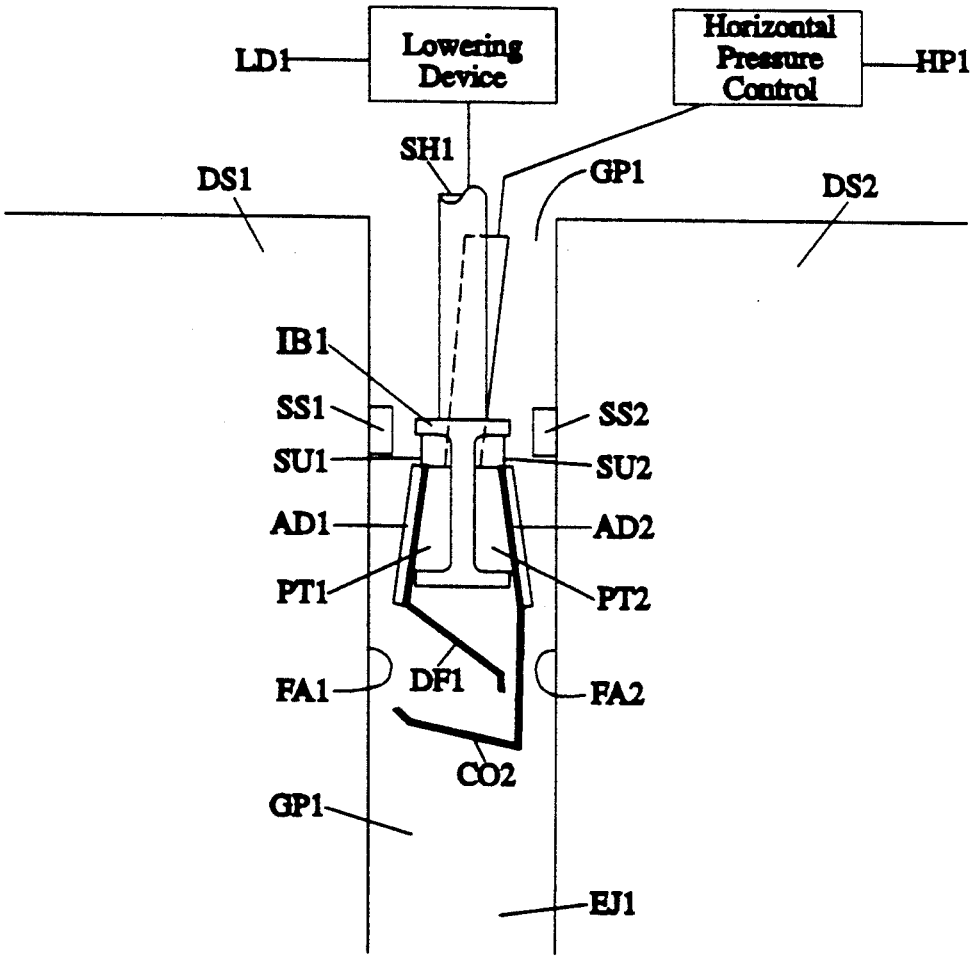
FIG. 6 is a sectional view of mounting means for mounting the run-off arrangement against the walls of an expansion joint from which the seal has been removed and which shows a method and means embodying features of the invention.

FIG. 6 illustrates an apparatus and method for securing the run-off assembly CA1 to the faces FA1 and FA2 forming the gap GP1 of the expansion joint EJ1. The process starts by removing the seal RS1 and cleaning the surfaces of the faces FA1 and FA2.

In FIG. 6 the seal RS1 has been removed and the faces cleaned. A lowering device LD1 lowers an I beam or structural mandrel IB1 with a shaft SH1 into the gap GP1 in the expansion joint EJ1. Support sections SU1 and SU2 magnetically or mechanically hold the deflector DF1 and collector CO2 against the I beam. The adhesive mounts AD1 and AD2 appear at the backs of the deflector DF1 and collector CO2 in an uncured condition. A horizontal pressure control HP1 triggers pressure thrusters PT1 and PT2 mounted on respective sides of the I beam IB1. The actuators PT1 and PT2 may take the form of bellows expansible horizontally under pressure from compressed air in the control HP1, compressed expansion springs which can be magnetically released by the horizontal pressure control HP1, electromagnetic repulsion devices, or other means for driving the adhesively backed portions of the deflector DF1 and the collector CO2 against the faces FA1 and FA2 so that the deflector DF1 and the collector CO2 adhere to the faces FA1 and FA2 as shown in FIG. 1.

In operation of FIG. 6, the lowering device LD1 lowers the I beam IB1 with the loaded pressure actuators PT1 and PT2 behind the deflector DF1 and collector CO2 as shown in FIG. 3 into a space below the seal seat SS1 and SS2. The horizontal pressure control HP1 then actuates the hydraulic, fluid, spring, electromagnetic repulsion, or other force devices to force the adhesive carrying deflector and collector EF1 and CO2 against the faces FA1 and FA2 into the positions shown in FIG. 1.

Figure 8:
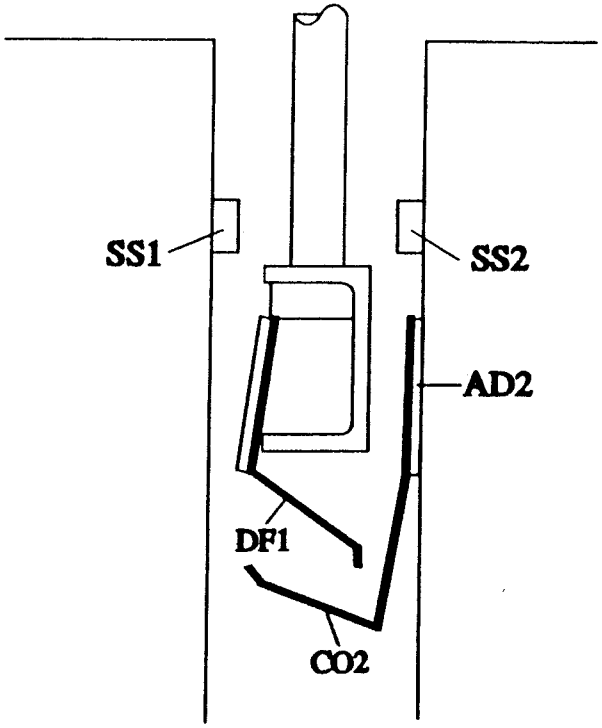
FIG. 8 is a cross sectional view illustrating mounting of a deflection portion of the run-off arrangement embodying the invention.
Figure 7:
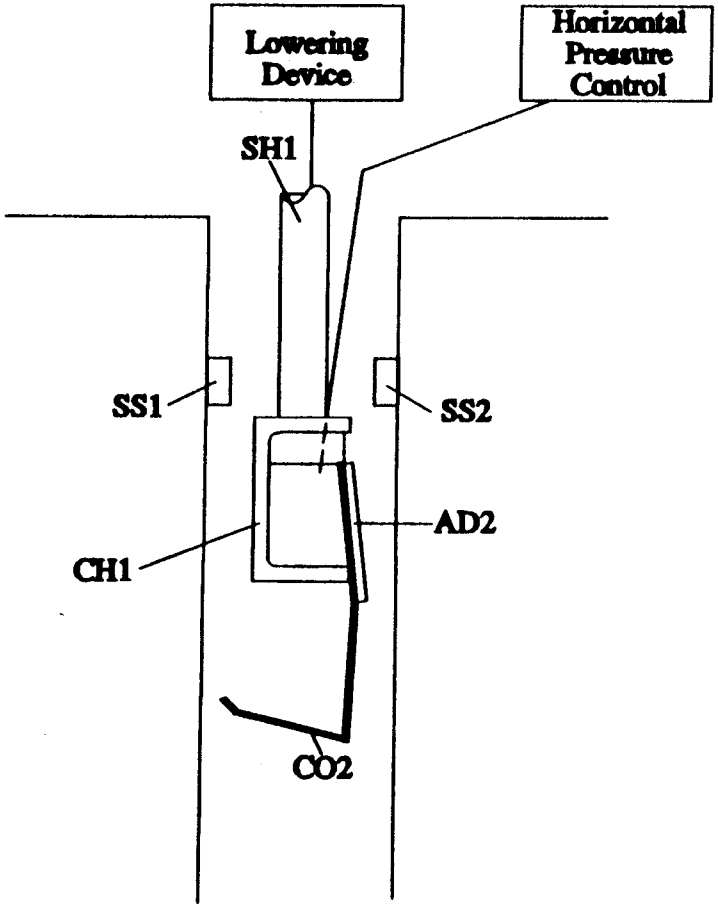
FIG. 7 is a cross sectional view showing suitable means in the process of mounting a collector portion of the run-off arrangement onto one wall of a gap formed in the expansion joint and embodying features of the invention.

FIGS. 7 and 8 illustrate other means for mounting the deflector and collector DF1 and CO2, particularly into gaps GP1 whose spaces are too small to accept both the deflector DF1 and the collector CO2 at the same time. Here, the lowering device LD1 lowers a channel CH1 that carries the collector CO2 with the adhesive backing AD2 into the gap GP1 below the seal seats SS1 and SS2. The horizontal pressure control HP1 actuates the pressure actuator PT1 which forces the collector CO2 against the face FA2 into the position shown in FIG. 1 and 5. As In FIG. 1, the control HP1 energizes the pressure actuator PT1 by initiating hydraulic or fluid (pneumatic) pressure, starting electromagnetic force; releasing springs, or the like. When the adhesive backing AD1 cures enough to hold, the horizontal pressure control HP1 releases the horizontal pressure by causing the PT1 to turn off the hydraulic or fluid pressure, retracting the springs, turning off the electromagnetic thrusters or other means. Thereafter, the lowering device LD1 withdraws the channel CH1.

The lowering device LD1 then reverses the horizontal direction of the channel CH1 and the horizontal pressure control HP1 sets the horizontal pressure thruster PT1. The lowering device LD1 then lowers the channel CH1 with the deflector DF1 into the gap GP1 at a space opposite the collector CO2 and the pressure control HP1 triggers the pressure thruster PT1 to drive the deflector DF1 and the adhesive AD1 against the face FA1. When the adhesive AD1 has cured, the control HP1 releases the thruster PT1 by eliminating the hydraulic or fluid pressure, retracting the springs, eliminating the electromagnetic repulsion, or otherwise eliminating the horizontal thrust and withdraws the channel. This sets the run-off arrangement as shown in FIG. 1.

In FIGS. 7 and 8, the horizontal control HP1 keeps causing the pressure thrusters PT1 and PT2 to hold the deflector DF1 and the collector CO2 against the faces FA1 and FA2 until the adhesives AD1 and AD2 have at least partially cured enough to hold the deflector and collector against the faces. Thereafter, the horizontal pressure control deactivates the pressure thrusters' hydraulic or fluid (pneumatic) pressure, retracts the springs, deactivates the electromagnetic repulsion, or otherwise withdraws the horizontal pressure so that the lowering device can withdraw the I beam IB1 from the gap GP1. Thereafter, the seal RS1 is forcefitted above the seal seats SS1 and SS2 as shown in FIG. 4.

The run-off arrangement RA1 avoids the leakage which the seal RS1 may permit because it hangs off separate walls and is not subject to the same forces as the seal. The deflector DF1 and the collector CO2 may move independently of each other. They do not receive forces which might distort and damage other structures between the faces FA1 and FA2.

According to an embodiment of the invention, caulking between the top rims of the deflector DF1 and the collector CO2 and the respective faces FA1 and FA2 furnish further protection against leaks. According to still another embodiment welds, or mechanical means such as bolts, with or without adhesive materials AD1 and AD2, but with caulking, hold the deflector DF1 and collector CO2 against faces FA1 and FA2.

The gap GP1 between the faces FA1 and FA2 may be as small as one-half inch and as wide as 3 inches. The lengths and angles of the bends in the deflectors FD1 and collectors CO2 vary accordingly.

Joints such as the joint EJ1 extend not only across the longitudinal direction of an elevated roadway but may also external longitudinally. For that purpose the collectors CO1 include spouts to direct the collected liquid away from piers, caps, and other structural members.

Expansion joints such as joints, ED1 protect not only against thermal expansion but other movements of roadway sections or deck section DS1 and DS2. Also the lowering device LD1 may be of the hydraulic, pneumatic, mechanical, manual, or other type.

Figure 9:
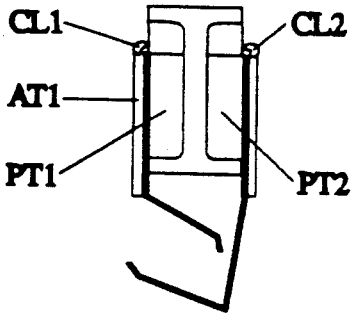
FIG. 9 is a sectional view of a thruster using clips hold the run-off members according to the invention.
Figure 10:
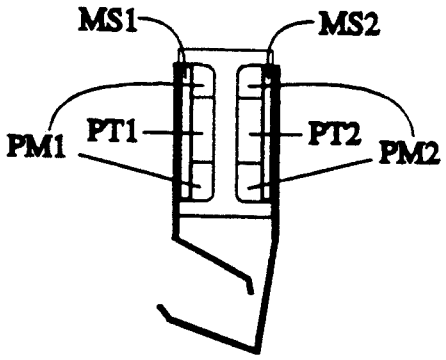
FIG. 10 is a section view of a thruster using magnets according to the invention.

For mechanically holding the deflector DF1 and the collector CO2 on the I beam IB1 and the channel CH1, biasing clips CL1 on the support SU1 and SU2 grasp the members DF1 and CO2 and secure them in the position shown in FIG. 9. For magnetic attachment, permanent magnets PM1 and PM2 attract magnetic sections MS1 and MS2 to hold the members DF1 and CO2 in position as shown in FIG. 10. FIGS. 9 and 10 apply equally to channels as well as I beams.

The adhesive materials AD1 and AD2 are thick enough to fill interstices in both the faces FA1, or FA2 and whatever breaks exist in the member DF1 and CO2.

The process for applying the run-off arrangement RA1 avoids removing the seal seats SS1 and SS2. These seats may be removed and replaced by means other than those connected with the present invention. Normally however, the seal seats SS1 and SS2 are firmly mounted by welding, bolting or otherwise in the faces FA1 and FA2.

Figure 11:
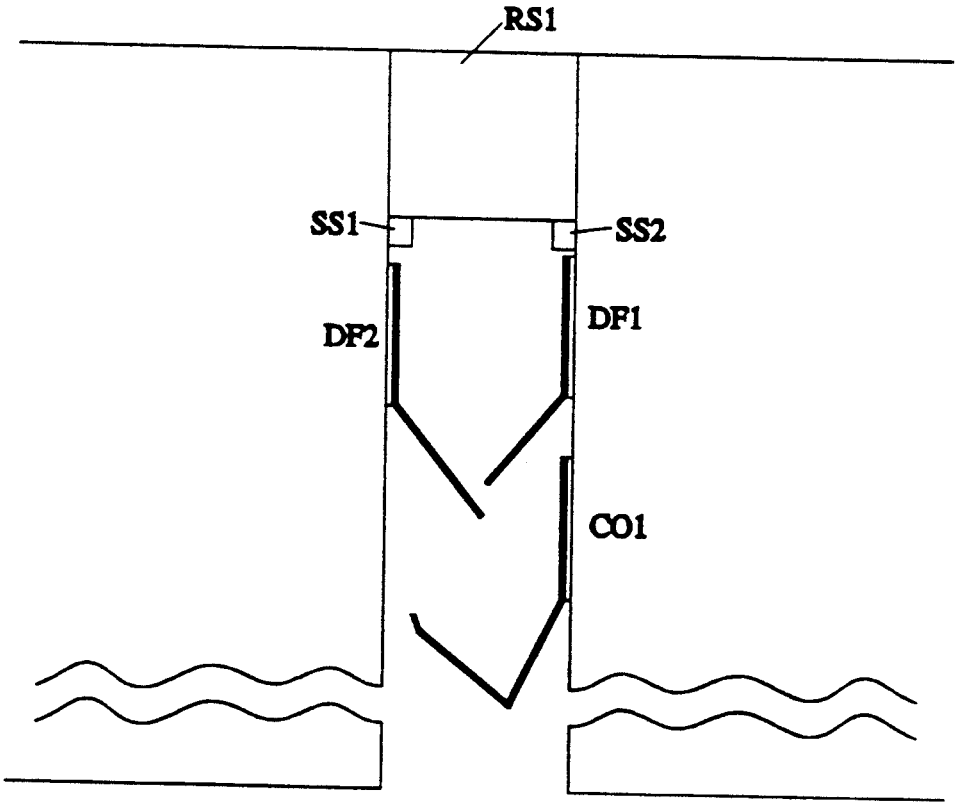
FIG. 11 is a section of another run-off arrangement the invention.

According to another embodiment of the invention, the systems of FIG. 4, 5, 10 apply to two deflectors and a single collector as shown in FIG. 11. The manner of application is the same in FIGS. 4 to 10. However, it involves applying first the collector, and than the lowermost deflector DF2 and lastly the upper deflector DF1. This embodiment embraces all of the other embodiments for application and positioning.

Numerous variations and modifications of the present invention exist. It should therefore be understood that the invention may be practiced otherwise than as specifically described herein.

In summary, the invention automatically installs premanufactured expansion joint run-off assemblies between existing sections of bridges, or other elevated roadways. A cleaning device first cleans the abutment between adjacent sections of roadway of debris and dirt. The hydraulic device 23 then positions the applicator 20 above any joint 14 and lowers the prefabricated water run-off assembly 29 into the abutment. Once positioned, the working head 21 expands, pressing the prefabricated plates 33 and 35 against the interior walls of the abutment. The water run-off assembly attaches to the abutment walls with waterproof adhesive preapplied to the mats 43 and 45 the water run-off assembly. The water run-off assembly 29 is held into position against the walls of the roadway abutment until the adhesive cures, and the device 23 withdraws the applicator 20 from the abutment. Once removed, a new length of prefabricated water run-off assembly 29 is attached to the working head of the applicator 20, and the application procedure is repeated. With the water run-off assembly 29 installed, the sealer 51 seals the abutment joint of the roadway from roadway run-off that corrodes the roadway and the underlying superstructure. Consequently the present invention allows existing bridges and other elevated roadway to be retrofitted efficiently and cost effectively, reducing the need for maintenance and future repairs.

The invention is effective because bridges and other elevated roadways are exposed to the elements more than any other structure in civil engineering. As a result, bridges and elevated roadways corrode rapidly and require a large amount of preventive maintenance and periodic repair. Bridges and elevated roadways have steel superstructures supporting their weights. These superstructures expand and contract with fluctuations in temperature throughout the year. Consequently such structures require expansion joints to be incorporated within their design. The presence of expansion joints on an elevated roadway disrupts the path of water on the surface of such roadways. Consequently, roadway water often leaks down through expansion joints and onto the superstructure in areas not designed to accept such a run-off flow. Additionally, roadway water is highly contaminated with oils, salts and acids that increase the corrosive ability of the flow on the steel superstructure. If such contaminated water continuously contacts bearing pads, rivets, cables and support members, a bridge can quickly deteriorate, become unsafe and need millions of dollars in costly repairs.

For decades, the problem of water flow through expansion joints has been an unavoidable aspect of bridge design. Even modern seals leak. Civil engineers and city planners have developed maintenance schedules for bridges with run-off corrosion as a primary consideration, and for over a century bridge corrosion from run-off has been endured. Maintenance programs for bridges and other elevated roadways have cost local governments billions of dollars. The present invention reduces the cost of maintenance of existing bridges by retrofitting them within expansion joints. Such run-off devices could be effectively retrofitted to existing bridges, so that the required maintenance for corrosion, painting, discoloration and reinforcement of existing structures could be greatly reduced.

Most existing run-off devices must be positioned between the abutment of adjacent roadways as such roadways are being formed. This traditional approach does not lend itself to retrofit applications. For such a system to be installed, the edges of each segment of roadway would have to be torn up, the run-off device installed, and the roadway edges re-laid. This process of retrofitting a roadway abutment, requires a large construction project, with a large initial outlay of capital. More importantly, such a retrofit operation would close the bridge or elevated roadway causing large traffic problems for a substantial amount of time.

The present invention provides a long awaited alternative for retrofitting existing bridges. To use the present invention the abutment between two adjacent segments of elevated roadway are cleaned of debris, dirt, and any other contaminants. The present invention them lowers a length of prefabricated run-off assembly down between the walls of the abutment. Once properly positioned, the present invention expands, pressing the run-off assembly against the walls of the abutment. The run-off assembly carries a waterproof adhesive that adheres to the wall of the abutment. Once the adhesive is cured, the applicator contracts, to disengage the run-off assembly and the hydraulic device 23 withdraws the applicator 20 from the abutment. The applicator 20 then receives a new length of run-off assembly, and the operation is be repeated at a new location.

The present invention does not require segments of the existing roadway to be torn up and replaced. Consequently, bridges and elevated roadways can be retrofitted quickly during off peak hours, and limit the effect the retrofit will have on local traffic conditions. Local governments no longer have to finance large amounts of capital for retrofit construction projects and governments will save millions of dollars on reduced maintenance, repair and replacement costs.

While embodiments of the invention have been described in detail, it will be evident to those skilled in the art that the invention may be embodied otherwise without departing from its spirit and scope.

What is claimed is:

1. A method which comprises:

adhesively securing a run-off arrangement on opposing vertical faces that form a gap in an expansion joint of a roadway;

said adhesively securing step including:

a. removably mounting a run-off member on a horizontal thrusting device, with the member having an adhesive section facing away from the thrusting device;

b. lowering the thrusting device and the member into the gap between the vertical faces;

c. pressing the adhesive section of the member against one of the vertical faces by actuating the horizontal thrusting device;

d. deactuating the thrusting device; and e. withdrawing the thrusting device from the gap; and said securing step further including applying a second member horizontally overlapping the first member against the other of the faces within the gap.

2. A method as in claim 1, wherein:

said applying step further includes:

a. removably mounting a second run-off member on the horizontal thrusting device before lowering the thrusting device, the second member having an adhesive action facing away from the thrusting device; and b. pressing the adhesive section of the second run-off member on the horizontal device against the other of the vertical faces simultaneously with the first member.

3. A method as in claim 1, wherein the step of applying includes:

a. removably mounting a second run-off member on the horizontal thrusting device after withdrawing the thrusting device from the gap, the second member having an adhesive section facing away from the thrusting device;

b. lowering the thrusting device and the member into the gap between the vertical faces so that the adhesive section faces the other of the faces;

c. pressing the adhesive section of the member against the other of said faces by again actuating the horizontal thrusting device;

d. again deactuating the thrusting device; and e. withdrawing the thrusting device from the gap.

4. A method as in claim 1, further comprising the steps of:

removing a resilient seal from the gap before lowering the thrusting device into the gap below the position of the seal; and replacing a resilient seal into the gap after withdrawing the device.

5. An expansion joint comprising:

a seal compressed between vertical faces at a gap;

a water run-off arrangement adhesively secured in the faces at a gap;

said run-off arrangement including two elongated overlapping portions each adhesively secured to one face extending along the gap and projecting toward each other so to overlap across the gap.

6. An apparatus for retrofitting a water run-off arrangement to the vertical faces at a gap of an expansion joint, comprising:

elongated thrusting means having vertical sidewalls;

holding means in said elongated thrusting means for holding elongated member of a run-off arrangement along on of the vertical sidewalls;

remotely actuable horizontal pressure applying means in said elongated thrusting means for applying force on the member in a direction away from said thrusting means;

lowering means for lowering said thrusting means into the gap and withdrawing said thrusting means from the gap;

control means for actuating the pressure applying means and doing said pressure applying means to force the member against one of the faces.

7. An apparatus as in claim 6; where said thrusting means includes second holding means for holding a second elongated member of the run-off arrangement along the other of the vertical sidewalls;

said thrusting means includes second pressure applying means for applying force on the second member in a second direction opposite to that of the first direction;

said control means including means for actuating said second applying means and causing said second pressure applying means to force the second member against the other face.

8. An expansion joint water run-off assembly installation apparatus for installing a run-off water deflector plate and a complimentary run-off water collector plate within the abutment joint of two adjacent segments of roadway, said installation apparatus comprising:

a working head body have a top surface and at least two opposing side surfaces, each said opposing side surface having at least one aperture formed therein.

a shaft extending upwardly from said top surface of said working head body;

a positioning means for moving said shaft up, down, back and forth within said abutment joint of two adjacent segments of roadway;

an inflatable bladder attached to said working head body within means, spring or magnetic for temporarily holding either said run-off water collector plate or said run-off water deflector plate onto each said opposing side surface of said working head body, said deflector plate and said collector plate covering said apertures on said working head body when so held by said attachment means. Inflation means for expanding said inflatable bladders within said apertures.

9. The apparatus of claim 1 wherein said opposing side surfaces of said working head body are sloped to match the angle of said adjacent segments of roadway within said abutment joint.

10. The apparatus of claim 1 wherein said positioning means for moving said shaft is a hydraulic servo attached to said shaft, said hydraulic servo being supported by a wheeled vehicle resting upon the roadway above said abutment joint, the combination of the relative movements of said hydraulic servo and said wheeled vehicle giving said shaft the ability to move up, down and back and forth within said abutment joint.

11. The apparatus of claim 1 wherein said attachment means for temporarily holding either said run-off water deflector plate or said run-off water collector plate to said working head body is a plurality of spring clips that bias said deflector plate and said collector plate against said working head body.

12. The apparatus of claim 1 wherein said inflatable bladders, once inflated extend beyond said apertures from which said bladders are attached to s id working head body.

13. The apparatus of claim 5 wherein said inflatable bladders, once inflated, contact said run-off water collector plate and said run-off water deflector plate disengaging said collector plate and said deflector plate from said attachment means.

14. The method of protecting an expansion gap of a roadway from leakage, comprising:

removably mounting a deflector arrangement having an adhesively coated portion over a fluid expandable device;

lowering the expandable device and the deflector arrangement into the gap;

pressing the adhesively coated portion of the deflector arrangement into a portion of the gap by expanding the expandable device with fluid pressure;

compacting the expandable device by decreasing the fluid pressure; and withdrawing the expandable device.

15. A method as in claim 1, wherein the step of removably mounting the deflector arrangement includes:

mounting two deflector plates, each having an adhesively coated portion, on opposite sides of the expandable device.

16. A method as in claim 1, further comprising the steps of:

removing an expandable joint insert from the gap before lowering the device into the gap; and replacing an insert into the gap after withdrawing the device.

17. An expansion joint in the walls of an expansion gap of a roadway comprising:

an expandable joint insert in the gap;

a deflector arrangement adhesively secured in a wall of a gap in the roadway;

said deflector arrangement including two overlapping portions extending substantially across the gap.

18. A joint as in claim 10, wherein said deflector arrangement is secured to two walls of the gap.

* * * * *